US010667967B2

(12) United States Patent
Horacek

(10) Patent No.: US 10,667,967 B2
(45) Date of Patent: Jun. 2, 2020

(54) FOLDING WHEELCHAIR

(71) Applicant: Gregor Horacek, Ransbach-Baumbach (DE)

(72) Inventor: Gregor Horacek, Ransbach-Baumbach (DE)

( * ) Notice: Subject to any disclaimer, the term of this patent is extended or adjusted under 35 U.S.C. 154(b) by 196 days.

(21) Appl. No.: 15/739,661

(22) PCT Filed: Jun. 9, 2016

(86) PCT No.: PCT/EP2016/063134

§ 371 (c)(1),
(2) Date: Dec. 22, 2017

(87) PCT Pub. No.: WO2016/206985

PCT Pub. Date: Dec. 29, 2016

(65) Prior Publication Data

US 2018/0311087 A1 Nov. 1, 2018

(30) Foreign Application Priority Data

Jun. 23, 2015 (EP) ..... 15173451

(51) Int. Cl.

| | |
|---|---|
| ***A61G 5/08*** | (2006.01) |
| ***A61G 5/10*** | (2006.01) |
| ***A61G 5/12*** | (2006.01) |

(52) U.S. Cl.

CPC ..... *A61G 5/0825* (2016.11); *A61G 5/08* (2013.01); *A61G 5/0883* (2016.11); (Continued)

(58) Field of Classification Search

CPC .. A61G 5/0825; A61G 5/1054; A61G 5/0883; A61G 5/128; A61G 5/1062

(Continued)

(56) References Cited

U.S. PATENT DOCUMENTS

| | | | | |
|---|---|---|---|---|
| 4,493,488 | A | 1/1985 | Panaia et al. | |
| 4,840,390 | A * | 6/1989 | Lockard | A61G 5/00 280/250.1 |

(Continued)

FOREIGN PATENT DOCUMENTS

| | | | |
|---|---|---|---|
| DE | 10 2011 050800 | A1 | 12/2012 |
| WO | 2006/123663 | A1 | 11/2006 |
| WO | 2009/132409 | A1 | 11/2009 |

*Primary Examiner* — Jacob D Knutson
(74) *Attorney, Agent, or Firm* — Christopher C. Dremann, P.C.; Christopher C. Dremann

(57) ABSTRACT

A foldable wheelchair having side frames arranged on both sides of the wheelchair, a cross-strut assembly and seat tubes for receiving a seat cover, wherein the cross-strut assembly is mounted about parallel pivot axes in the side frames, and an axis of rotation of struts of the cross-strut assembly is arranged parallel to the pivot axes of the cross-strut assembly, and the cross-strut assembly is connected to the seat tubes, wherein the wheelchair has guide levers and each guide lever is mounted in the respective strut of the cross-strut assembly between the axis of rotation of the struts of the cross-strut assembly and the respective seat tube, and the guide lever is mounted at a distance therefrom in the side frame assigned to the seat tube so as to be pivotable about a pivot axis that is arranged parallel to the pivot axes of the cross-strut assembly.

15 Claims, 11 Drawing Sheets

(52) U.S. Cl.
CPC ..... *A61G 5/1054* (2016.11); *A61G 5/1062* (2013.01); *A61G 5/128* (2016.11)

(58) Field of Classification Search
USPC ..... 280/250.1
See application file for complete search history.

(56) References Cited

U.S. PATENT DOCUMENTS

| | | | | | |
|---|---|---|---|---|---|
| 4,981,305 | A * | 1/1991 | Lockard | A61G 5/00 | 280/250.1 |
| 4,989,890 | A * | 2/1991 | Lockard | A61G 5/00 | 280/250.1 |
| 5,560,627 | A * | 10/1996 | Zatulovsky | A61G 5/00 | 280/42 |
| 6,050,582 | A * | 4/2000 | Horacek | A61G 5/08 | 280/250.1 |
| 2006/0145456 | A1 * | 7/2006 | Munsey, Sr. | A61G 5/08 | 280/649 |
| 2016/0058637 | A1 * | 3/2016 | Horacek | A61G 5/08 | 280/649 |

* cited by examiner

FOLDING WHEELCHAIR

CROSS REFERENCE TO RELATED APPLICATIONS

This application is the United States national stage application of International Application No. PCT/EP2016/063134 filed on Jun. 9, 2016, which claims priority to European Application No. 15173451.4 filed on Jun. 23, 2015, the entire disclosures of which are incorporated herein by reference.

BACKGROUND OF THE INVENTION AND RELATED ART

The invention relates to a foldable wheelchair having side frames arranged on both sides of the wheelchair, a cross-strut assembly and seat tubes for receiving a seat cover, wherein the cross-strut assembly is mounted, in regions remote from the seat tube, about parallel pivot axes in the side frame, and the axis of rotation of the struts of the cross-strut assembly is arranged parallel to these pivot axes of the cross-strut assembly, and the cross-strut assembly is connected to the seat tubes, which, in the unfolded position of the wheelchair, are received by seat tube bearings of the side frames, wherein the wheelchair has guide levers on both sides, and the respective guide lever is mounted, in a first region, in a strut of the cross-strut assembly, in a region of the cross-strut assembly between the axis of rotation of the struts of the cross-strut assembly and the seat tube, and this guide lever is mounted at a distance therefrom, in a second region, in the side frame assigned to this seat tube so as to be pivotable about a pivot axis, wherein this pivot axis is arranged parallel to the pivot axes of the cross-strut assembly in the side frames.

Similar foldable wheelchairs are known from the prior art.

Basically, the folding mechanism of modern folding wheelchairs from virtually all wheelchair manufacturers is realized substantially by means of a so-called cross-strut assembly. These are two articulatedly interconnected struts which form an axis of rotation, wherein the articulation point is situated approximately in the center of the struts. Also known are so-called double cross-strut assemblies, in the case of which at least one strut part is composed of two struts arranged in parallel.

However, only the single design will be considered below.

Situated at the upper end of the struts are the seat tubes. They form a right angle with the struts, are oriented in a direction of travel and serve for the fastening of the seat cover. In the unfolded state, that is to say the usage situation of the wheelchair, said seat tubes are fixed in seat tube bearings fastened to the side frames.

At the lower end of the struts, these are articulatedly connected to the lower region of the side frames, wherein the axes of rotation are oriented in a direction of travel. Owing to the criss-crossing articulated connection of the struts, said struts are, in the unfolded state of the wheelchair, in each case connected at the lower end to one side frame and mounted at the upper end in the other side frame.

During the folding-together of the wheelchair, the seat tubes are, owing to tension on a seat cover of the wheelchair, guided upwardly out of the seat tube bearings, wherein the cross-strut assemblies and thus the wheelchair as a whole are folded together.

Since, after the release of the seat tubes from their bearings, the side frames are articulatedly connected only in the lower region to the cross-strut assembly, a guide lever is required in each case in order to prevent the side frames from tilting away to the side in uncontrolled manner and being guided in a controlled manner. Said guide levers are in each case articulatedly connected at one side to the upper region of a side frame and at the other side to that strut of the cross-strut assembly which is connected to the oppositely situated side frame. The axes of rotation of the guide lever are likewise oriented parallel to the direction of travel. In particular, the articulation point in the struts of the cross-strut assembly are selected such that the side frames are parallel to one another both in the unfolded state and in the folded-together state.

This is however not the case at the start of the folding process: owing to the geometric conditions arising from the design, the connecting line of the axes of rotation of a guide lever in the unfolded state of the wheelchair (usage situation) is, as viewed from the axis of rotation on the side frame, directed downward—below the horizontal in relation to the normal orientation of the wheelchair. During the folding process, the guide levers are rotated into the horizontal as a result of the movement of the cross-strut assembly, whereby the respective horizontal spacing from the axis of rotation at the cross-strut assembly to the axis of rotation at the side frame is increased, and the upper regions of the side frames are pushed outward, away from the cross-strut assembly. Since the side frames are articulatedly connected in their lower region to the cross-strut assembly, they perform a corresponding rotational movement there, such that the sagittal planes of the side frames moved toward one another at an angle from the parallel, and assume a V-shaped position. Thus, in this early phase of the folding process, the back tubes of the wheelchair move away from one another and generate a high tension on the back cover of the wheelchair if the latter does not have a correspondingly large degree of slack in the unfolded state of the wheelchair. This effect is intensified, in accordance with the V shape, with the height of the back cover.

In practice, this effect is counteracted in two ways, or by means of the combination thereof:

1. The back cover is provided with a degree of slack in the unfolded state of the wheelchair, which permits the V-shaped movement of the back tubes away from one another.
2. The guide levers, or the attachment thereof to the cross-strut assembly, are structurally designed such that they can bend during the folding process and thus compensate the approximately parallel guidance of the side frames that is forced by a taut back cover.
3. The articulated connection of the cross-strut assembly is produced with play, such that the cross-strut assembly itself can, together with the side frames connected thereto, be moved into a forwardly directed V shape, that is to say a V shape directed in the direction of travel, and thus compensate the movement of the back tubes away from one another.

The latter possibility is not applicable to modern, energy-efficient wheelchairs, because such a wheelchair must be as rigid as possible and must have the least possible play in its articulated connections.

The first two possibilities, or the combination thereof, are however associated with a considerable mechanical load on the guide lever and/or on the flexible attachment elements thereof on the cross-strut assembly and the cross-strut assembly articulation point. Furthermore, these methods of the combination thereof can only partially prevent the state effect. Complete prevention would require an unachievable deformation of guide levers and/or of the flexible attachment elements thereof on the cross-strut assembly.

OBJECTS AND SUMMARY OF THE INVENTION

It is an object of the present invention to further develop the foldable wheelchair of the type mentioned in the introduction such that the stated disadvantages are avoided, and substantially parallel guidance of the side frames of the foldable wheelchair throughout the entire folding process thereof is possible.

The object is achieved in the case of a foldable wheelchair of the type mentioned in the introduction in that the guide lever has a guide slot in its first region, and a guide pin, which engages in the guide slot, is connected to the strut assigned to the guide lever, and a cam is connected to the strut, and a cam follower is connected to the guide lever in its first region, wherein the cam and the cam follower interact in an end phase of the unfolding process of the wheelchair for the purpose of displacing the guide pin into a defined position in the guide slot.

Owing to the design of the wheelchair according to the invention, it is possible during the folding process thereof for the horizontal spacing of the axis of rotation of the guide lever on the strut to the axis of rotation of the guide lever on the side frame to be substantially maintained by displacement of the guide lever with its guide slot on the guide pin, and thus for the side frames to be kept substantially parallel. It is thereby ensured that the back cover is not subjected to excessive tension, and structural elements of the wheelchair are not subjected to excessive load, in any phase of the folding process.

In order that, at the end of the unfolding process, the seat tubes can be inserted as exactly as possible into the seat tube bearings of the seat frames, the side frames must be positively guided into the corresponding position. The guide slots in the guide levers would, in this phase of the folding process, allow the side frames to pivot inward, that is to say in the direction of the cross-strut assembly articulation point, whereby the seat tubes would miss the seat tube bearings, and the wheelchair cannot be correctly unfolded. The exact guidance is performed by the respective cam follower and the cam assigned thereto: during the unfolding of the wheelchair, the cam follower bears against the cam and the cam acts on the cam follower, such that the cam follower displaces the guide lever along its guide slot during the unfolding process. In particular, this displacement occurs as far as the end of said guide slot, which in turn corresponds to the position at the end of the unfolding process, at which the seat tube can be inserted exactly into the seat tube bearing.

It is provided in particular that the cam and the cam follower are out of contact before reaching the end phase of the unfolding process of the wheelchair. It is thus necessary for the cam and the cam follower to interact only when the end phase of the unfolding process is reached, in order to displace the guide peg into a defined position in the guide slot.

It is preferably provided that, in the defined position of the guide pin in the guide slot, the seat tube connected to this strut can be moved exactly into the seat tube bearing assigned to this seat tube. The movement sequences of guide lever and strut are thus precisely coordinated with the end phase of the unfolding process of the wheelchair.

It is considered to be advantageous if the respective seat tube bearing is designed to be upwardly open in order to move the seat tube assigned to the seat tube bearing in when unfolding the wheelchair with a movement component directed toward the opening of the seat tube bearing.

In particular, the seat tube bearing is formed as an upwardly open trough-shaped element. Said trough-shaped element preferably has a cross section which extends over a part of a circle, in particular over approximately a semicircle. This design permits a defined mounting with easy movement of the seat tube into the seat tube bearing during the complete unfolding of the wheelchair.

The guide slot preferably takes the form of an oblong hole traversing the guide lever. Thus, by virtue of the guide slot taking the form of an oblong hole, the function of the guide slot can be realized in a structurally simple manner in the guide lever, in that it is merely necessary for an oblong hole to be milled into the guide lever, which oblong hole traverses the guide lever.

The guide pin is preferably a constituent part of a fastening element which serves for fastening the cam to the strut. The fastening element thus performs firstly the function of the fastening of the cam to the strut, and secondly the guidance function of the guide pin. In this way, is possible firstly to reduce the variety of different parts, and secondly to optimize the outlay in terms of production and assembly.

The defined position of the guide pin in the guide is preferably a position of the guide pin at one end of the guide slot. The end of the guide slot is in particular that which is remote from the seat tube assigned to the strut.

The orientation of the cam on the associated strut of the cross-strut assembly and the design of the cam track are dependent on the geometrical conditions of the wheelchair construction. It is preferably provided that a center line of the cam and a longitudinal axis of the strut assigned to the cam assume an angle of 20 to 40°, preferably 25 to 35°, in particular 30°, with respect to one another.

The cam track that communicates with the cam follower preferably forms a concave surface.

The wheelchair is in particular designed such that, with the wheelchair unfolded, the seat tube is arranged adjacent to a tube portion of the facing seat frame.

In a preferred refinement of the invention, it is provided that the respective guide lever has in its first region a plurality of guide slots, preferably up to four guide slots, in particular three guide slots. It is furthermore preferably provided that the guide lever has a number of holes corresponding to the number of guide slots. Each guide slot is assigned a hole. In this arrangement one of the holes receives the cam follower and one of the guide slots receives the guide pin. In the case of such an alternative design, the different guide slots of the guide lever represent different seat width of a wheelchair. Thus, a guide lever with multiple guide slots can be used for different wheelchair widths. In particular, the guide slots are arranged parallel to one another and/or the respective hole is arranged in the continuation of the associated guide slot.

Further features of the invention are described in the detailed description of exemplary embodiments, in the description of the figures and in the figures themselves, wherein it should be noted that all individual features or all combinations of individual features constitute further embodiments according to the invention.

BRIEF DESCRIPTION OF THE DRAWING FIGURES

The accompanying drawing figures firstly illustrate the relevant prior art, with the invention subsequently being shown on the basis of a preferred exemplary embodiment, without being restricted thereto.

DETAILED DESCRIPTION OF EXEMPLARY EMBODIMENTS

Figure 1:
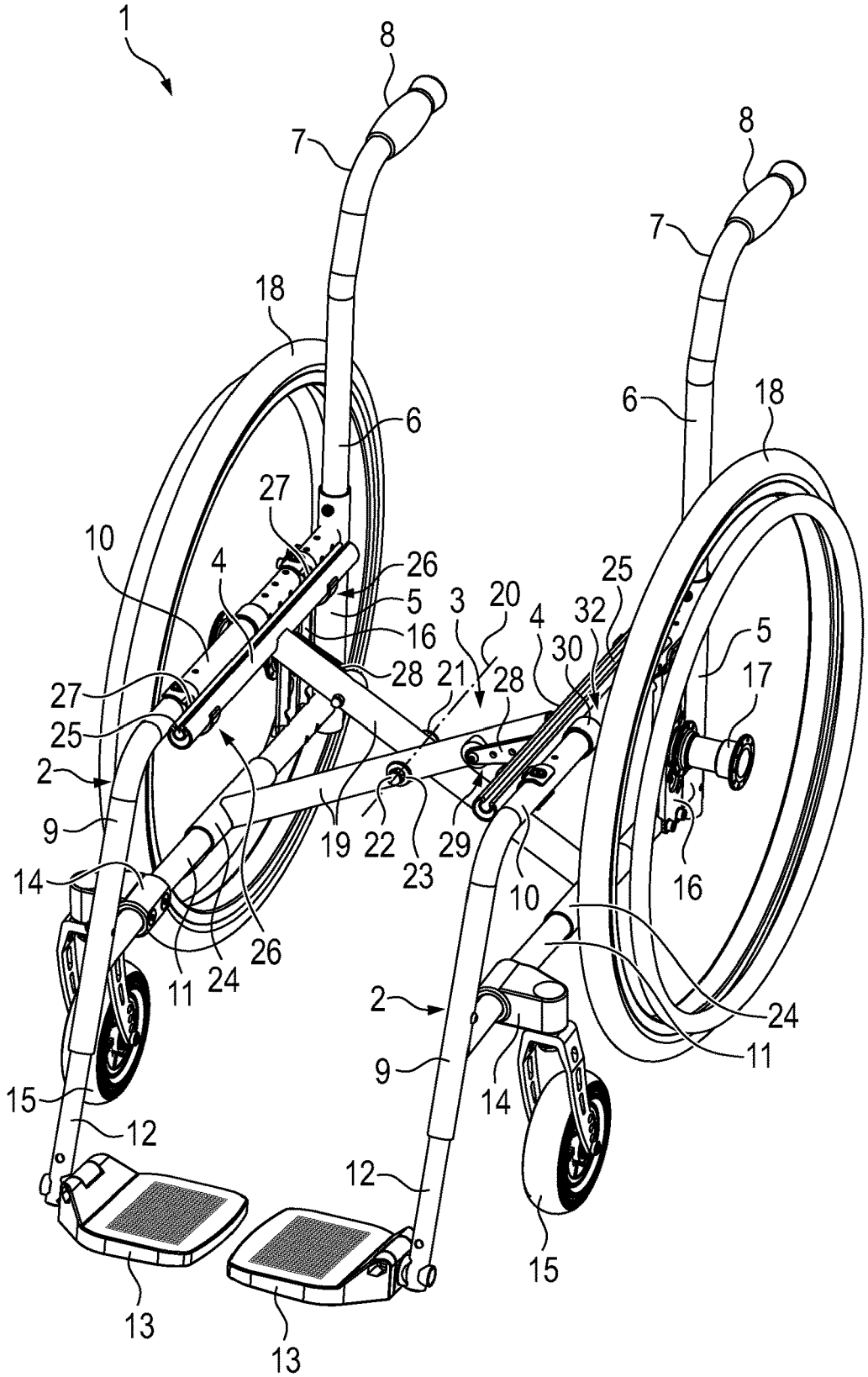
Fig. 1 (Prior Art)
FIG. 1 shows an unfolded wheelchair according to the prior art, illustrated in a view obliquely from the front and above, but illustrated without a seat cover and back cover.
Figure 2:
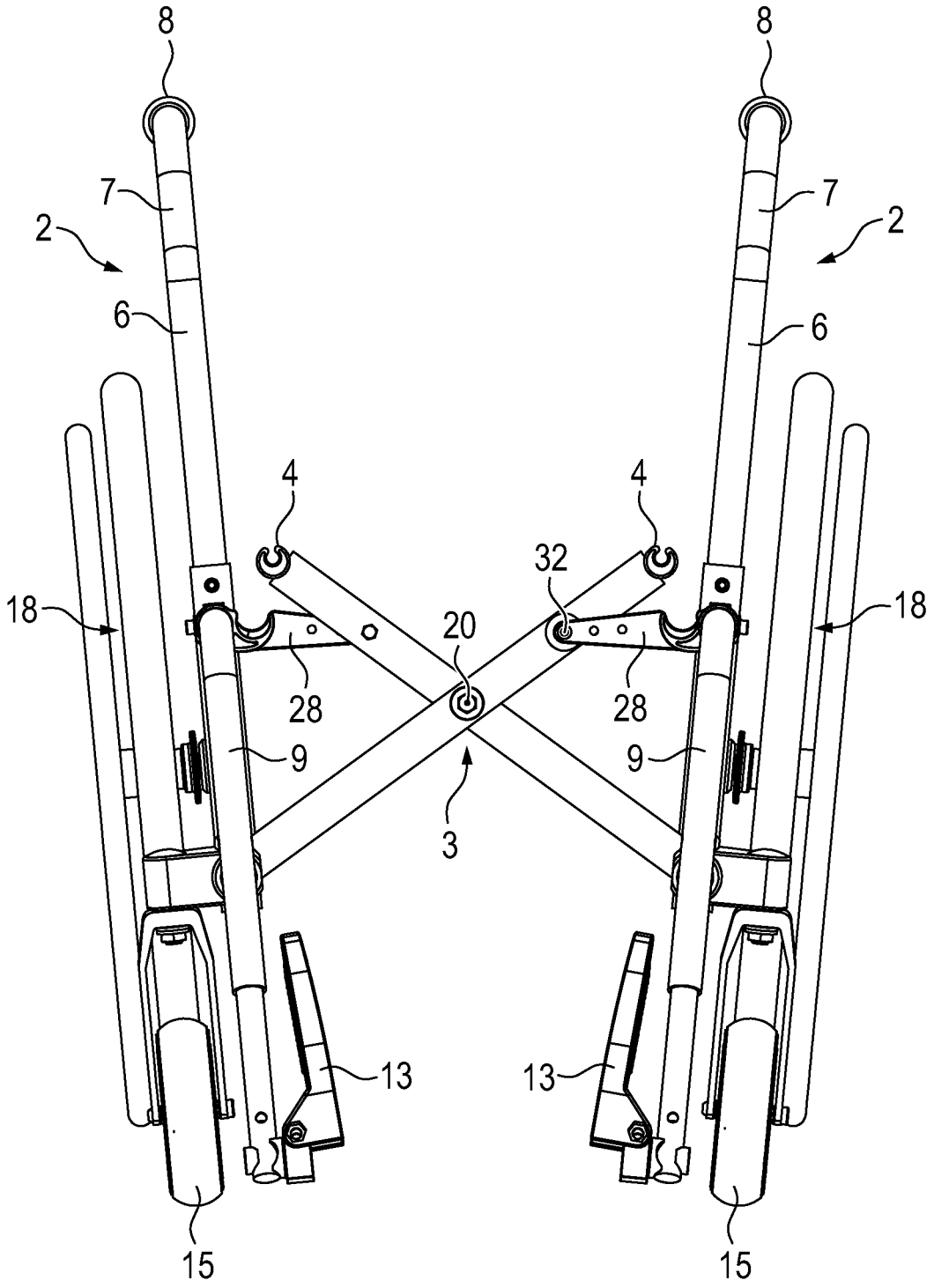
Fig. 2 (Prior Art)
FIG. 2 shows the wheelchair shown in FIG. 1 in a front view and in a slightly folded state.
Figure 3:
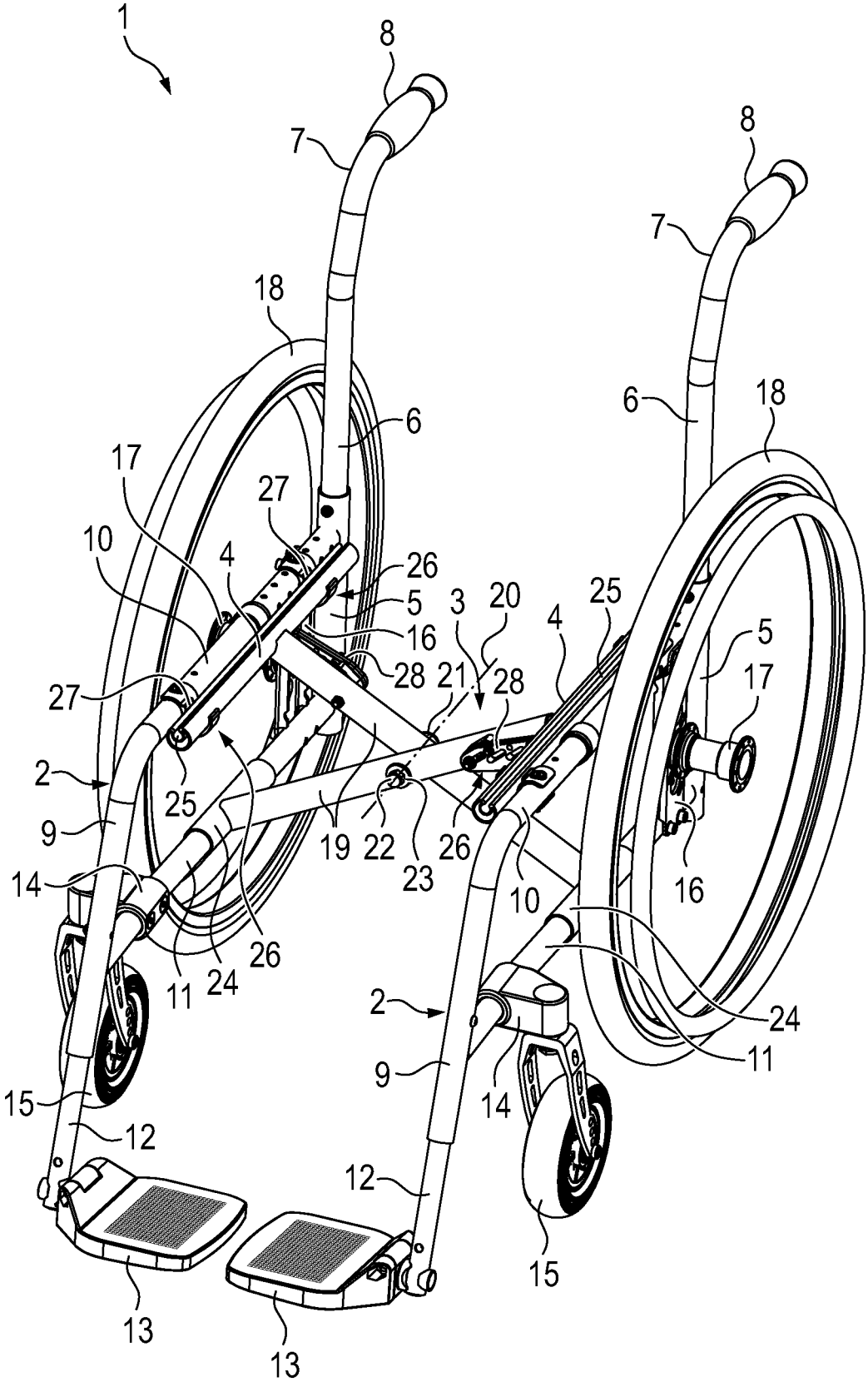
FIG. 3 shows an unfolded wheelchair according to the present invention, illustrated in a view obliquely from the front and above, but illustrated without a seat cover and back cover.
Figure 4:
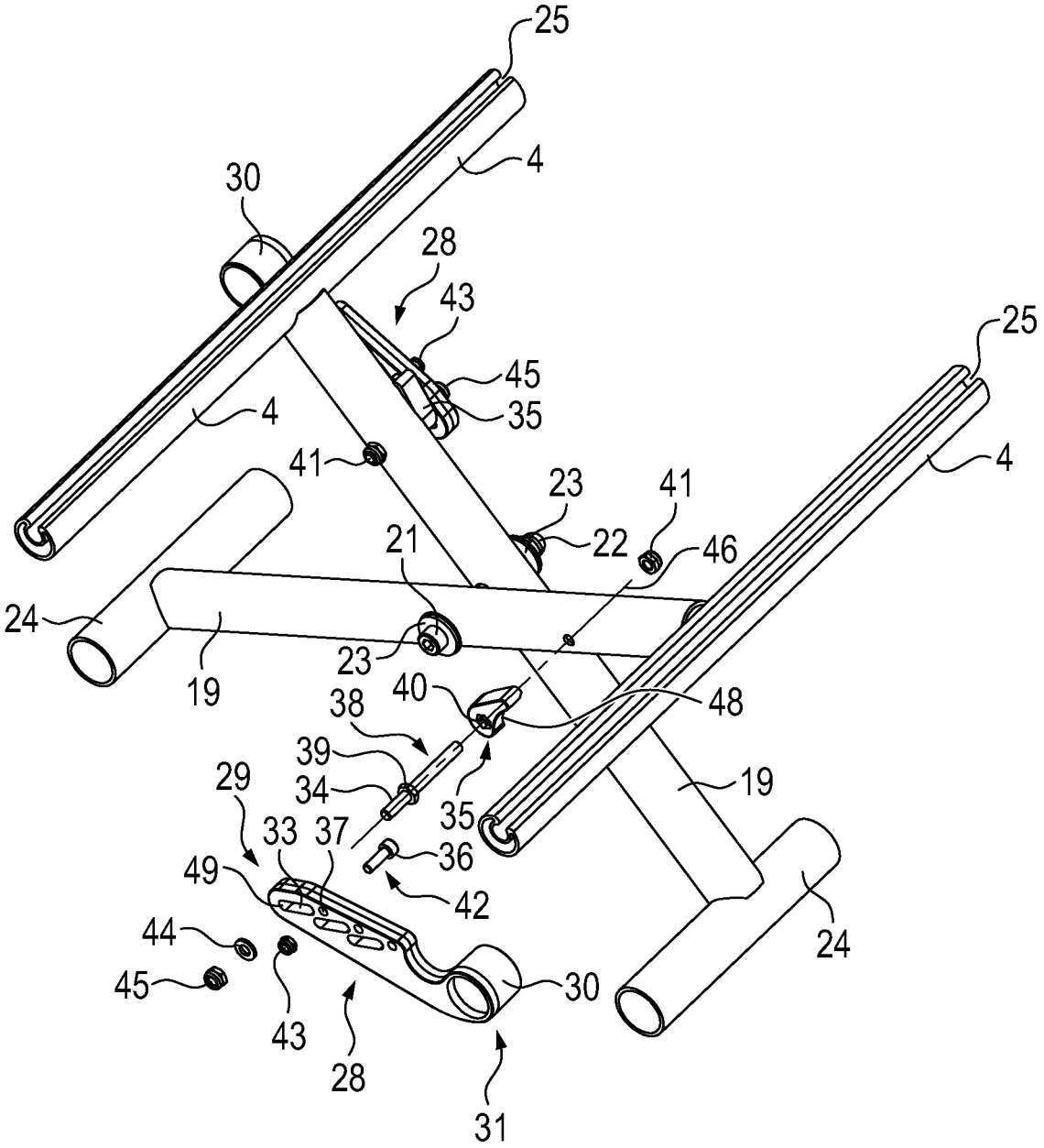
FIG. 4 shows a cross-strut assembly of the wheelchair, and the parts connected or connectable thereto, illustrated in a three-dimensional view as seen obliquely from above and partially in an exploded illustration.
Figure 5:
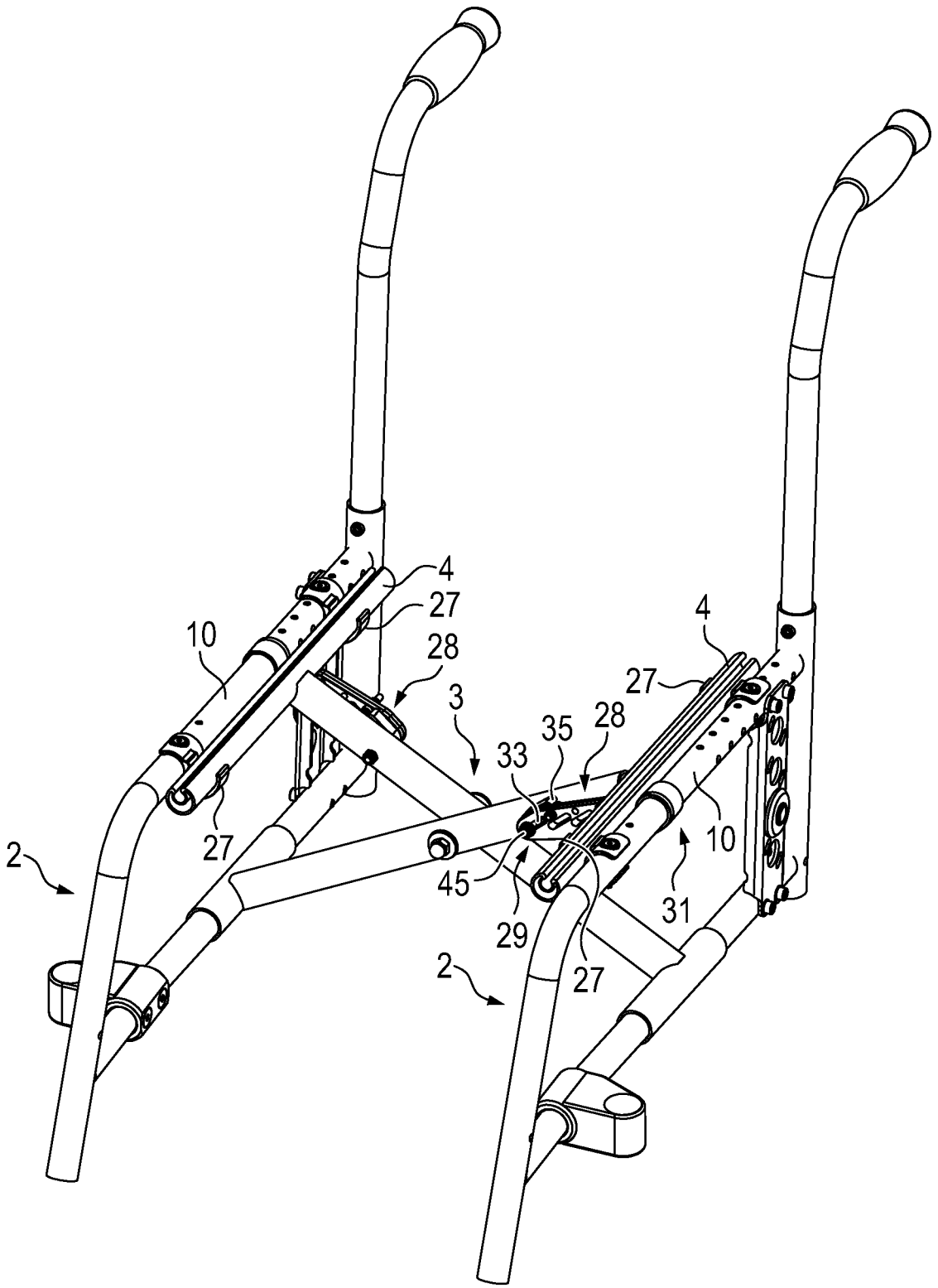
FIG. 5 shows the wheelchair shown in FIG. 3 in a three-dimensional illustration, but illustrated without its footrests and wheels.
Figure 6:
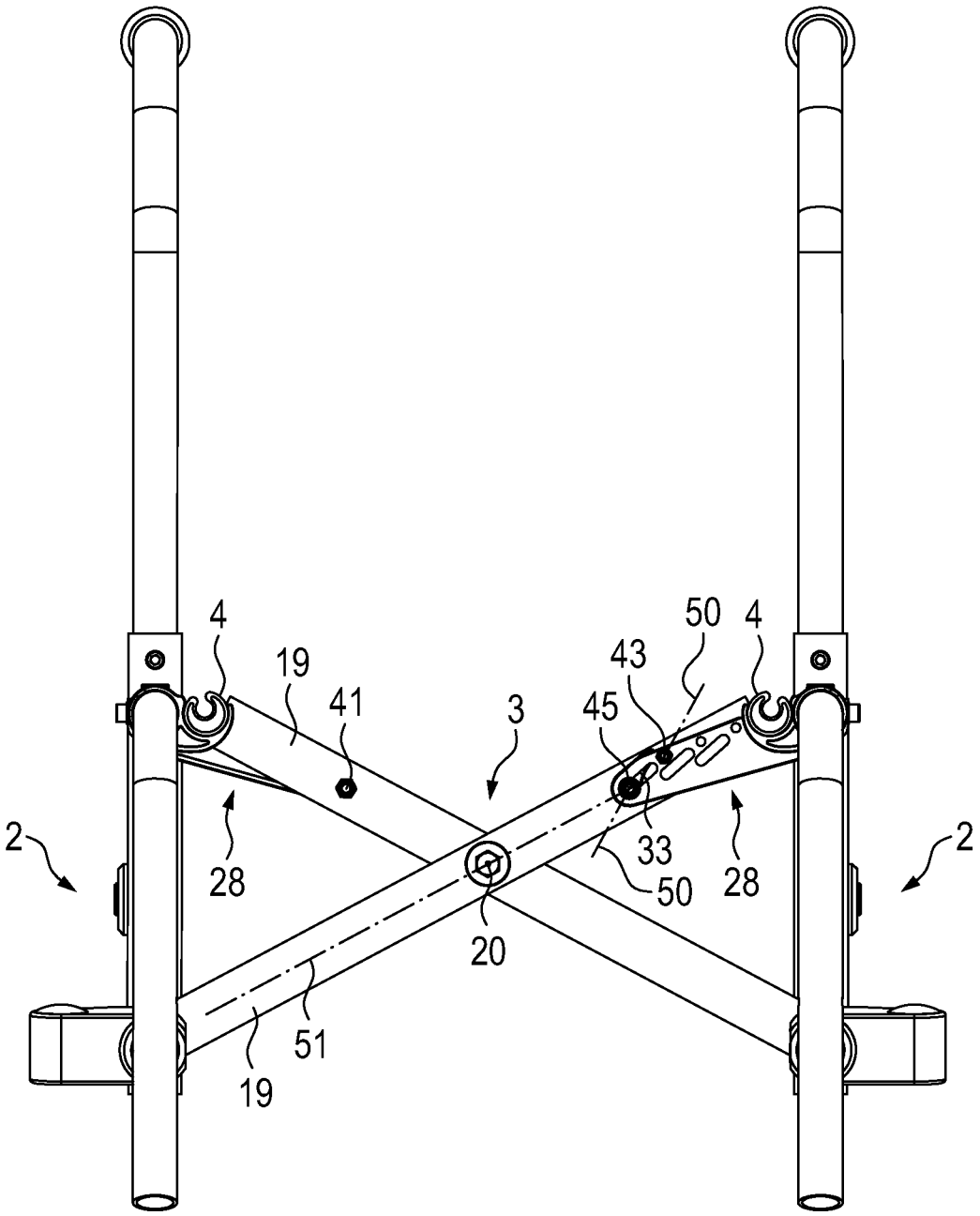
FIG. 6 shows the unfolded wheelchair as per FIG. 5 in a view from the front.
Figure 7:
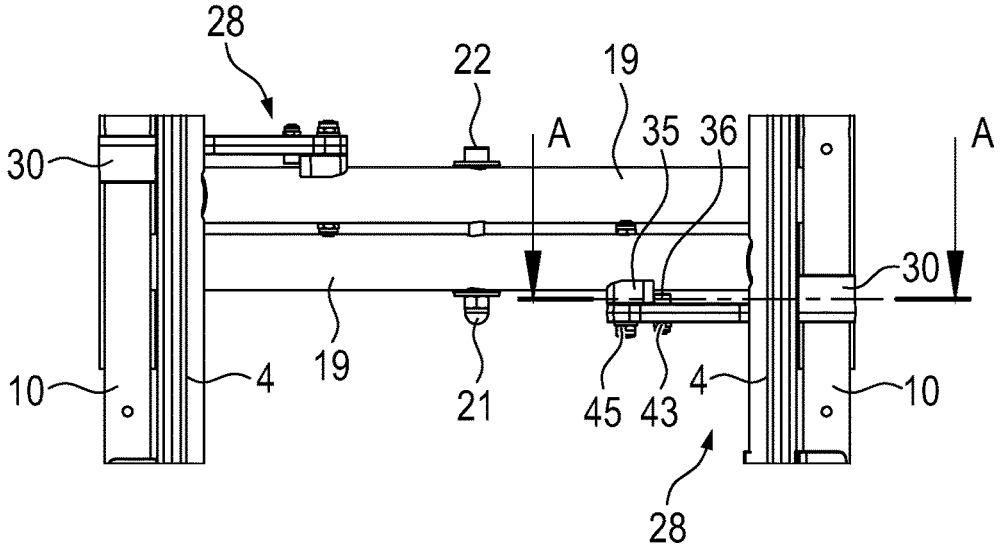
FIG. 7 shows a view of the wheelchair as per FIG. 5, illustrated in a view from above in a partial region, specifically the region of the cross-strut assembly.
Figure 8:
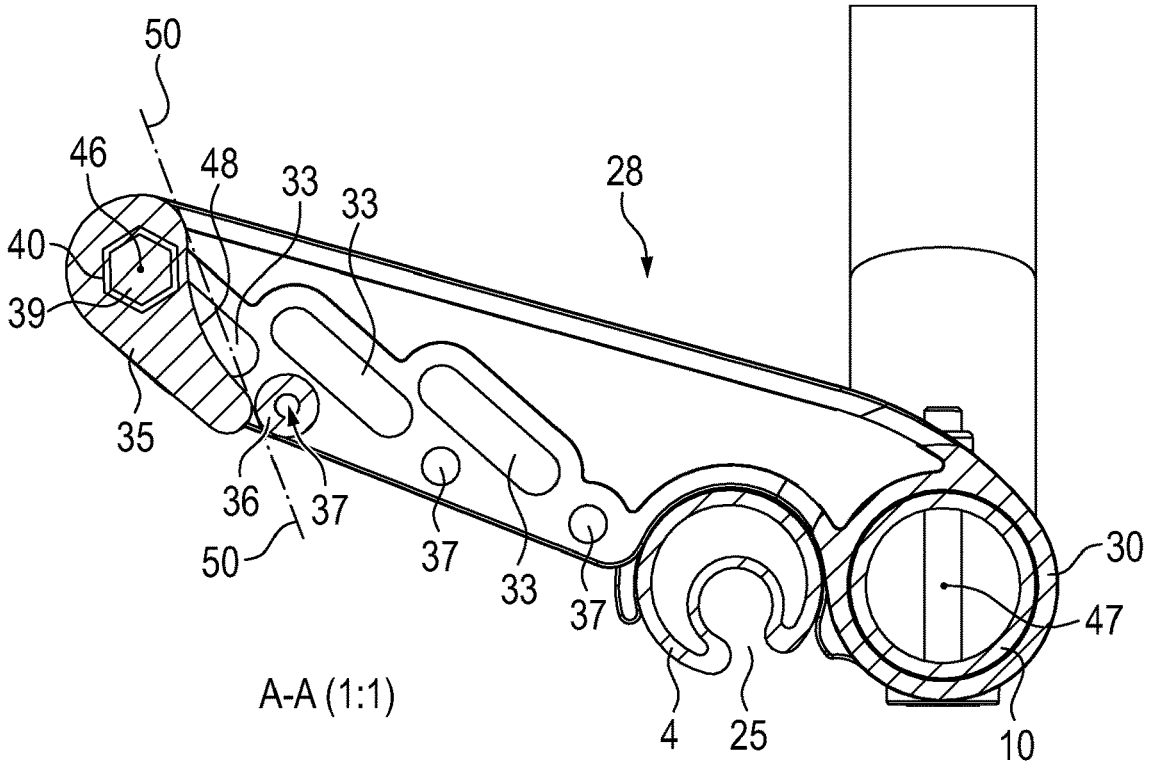
FIG. 8 shows a section as per the line A-A in FIG. 7 in an enlarged illustration.
Figure 9:
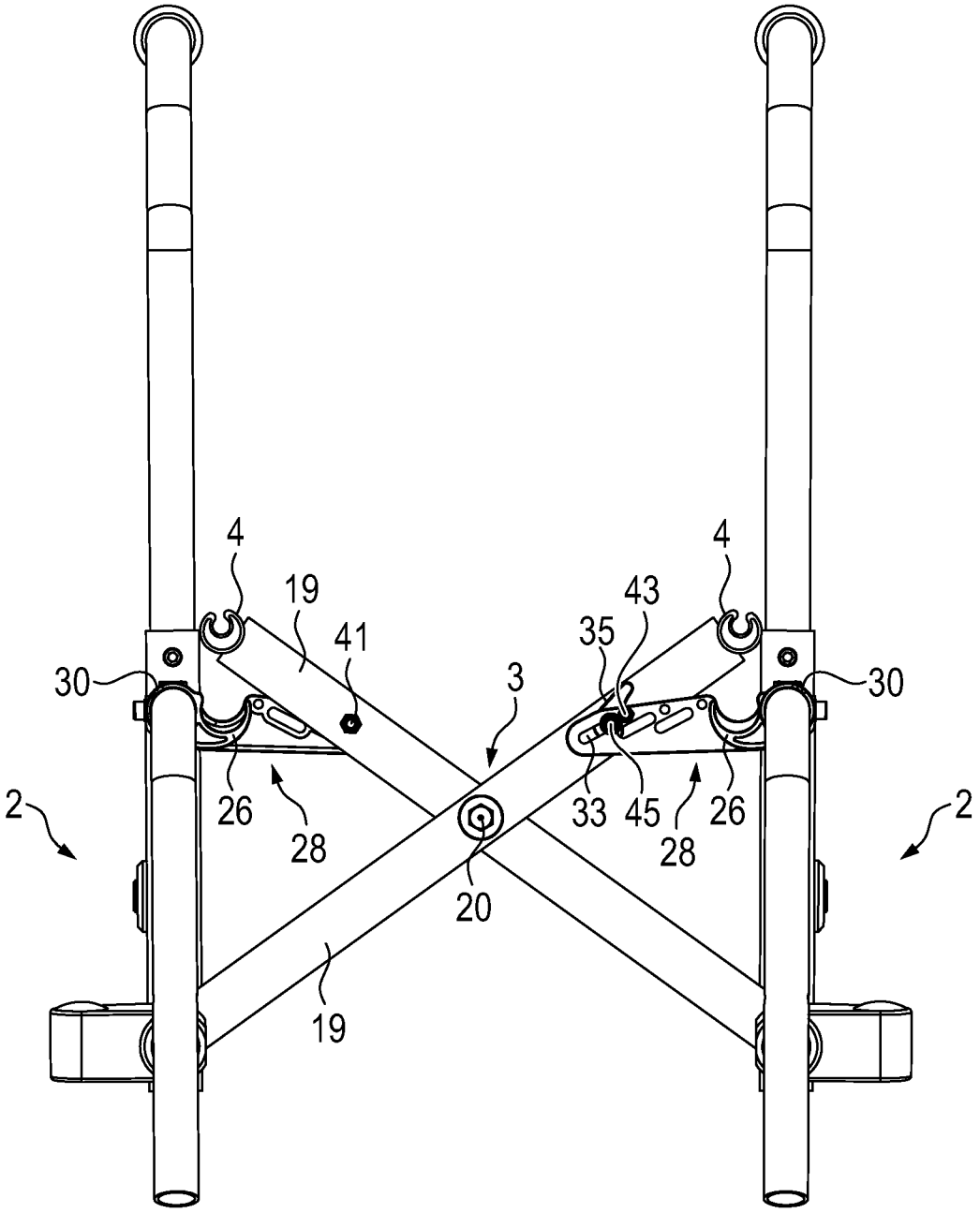
FIG. 9 shows the wheelchair as per FIG. 6 in a view from above in a partially folded position.
Figure 10:
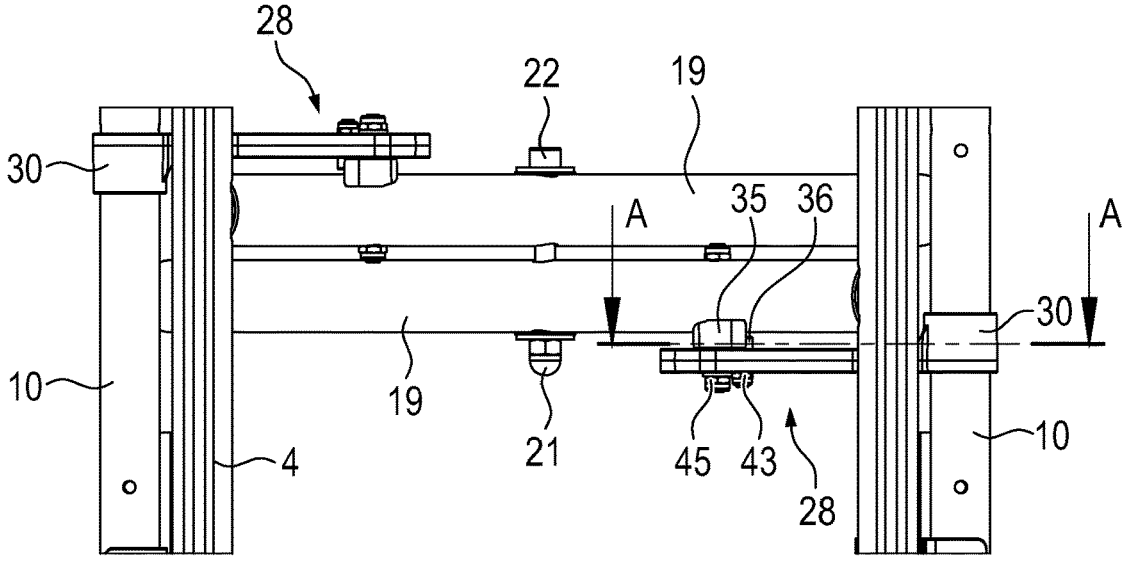
FIG. 10 shows a view of the wheelchair as per FIG. 9, illustrated in a view from above in a partial region, specifically the region of the cross-strut assembly.
Figure 11:
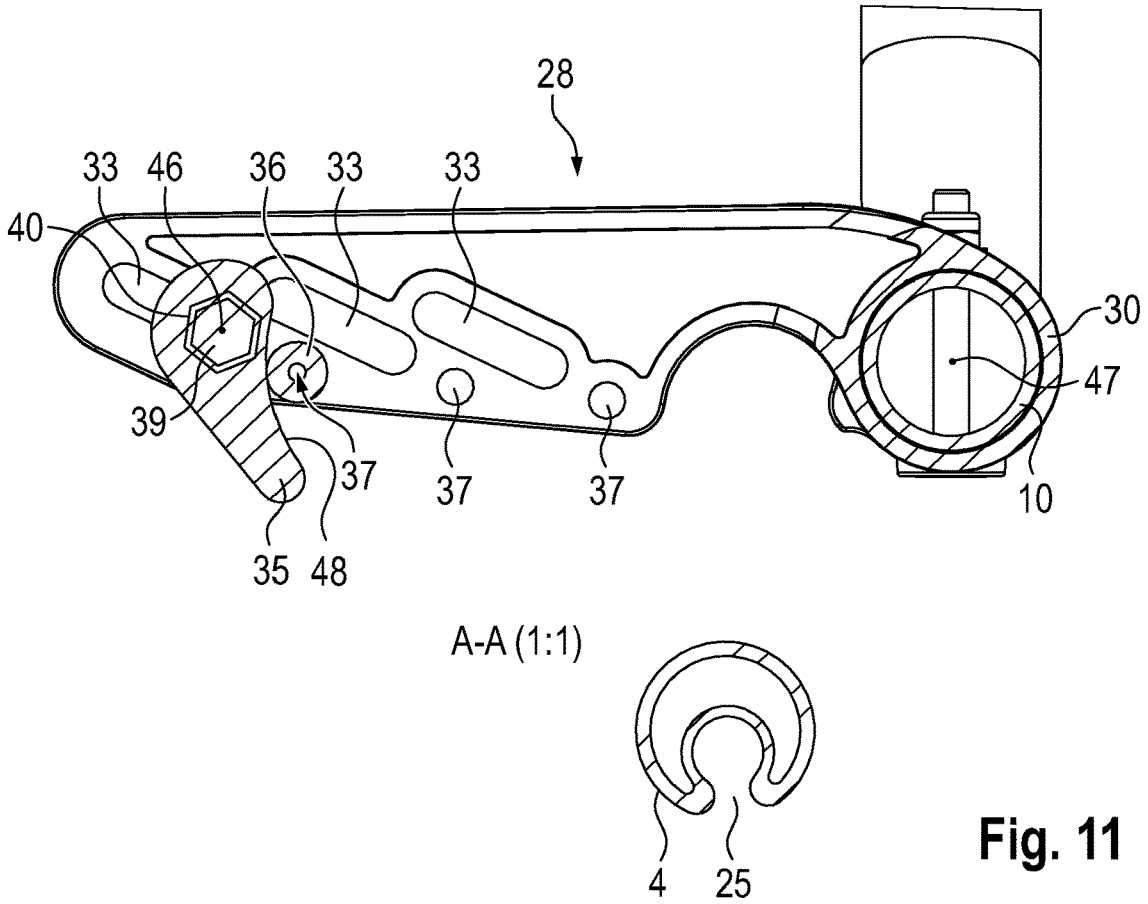
FIG. 11 shows a section as per the line A-A in FIG. 10 in an enlarged illustration.
Figure 12:
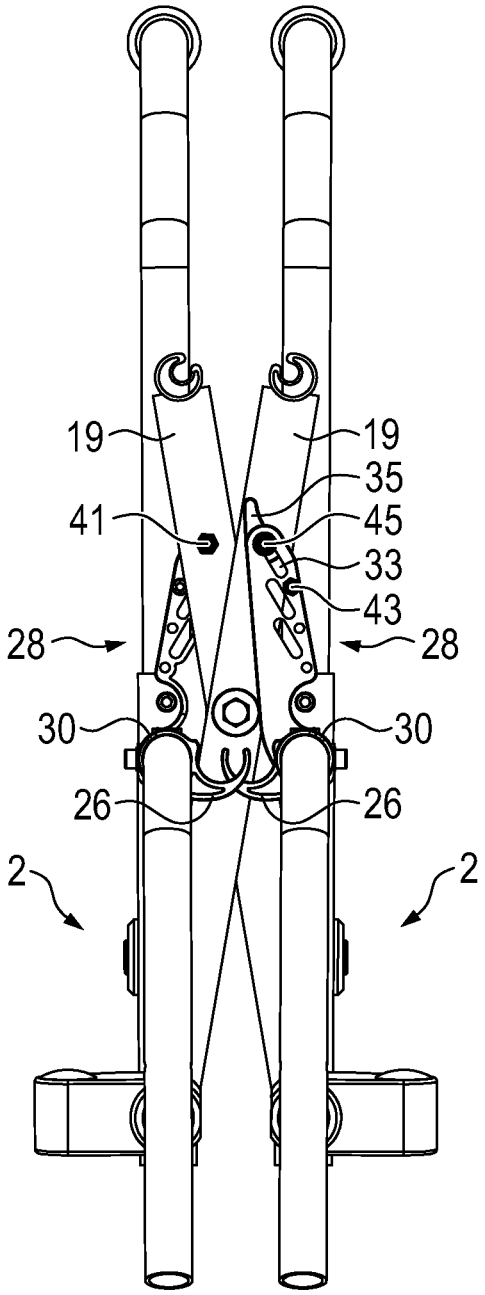
FIG. 12 shows the wheelchair as per FIGS. 6 and 9 in a view from the front in a folded-together position.
Figure 13:
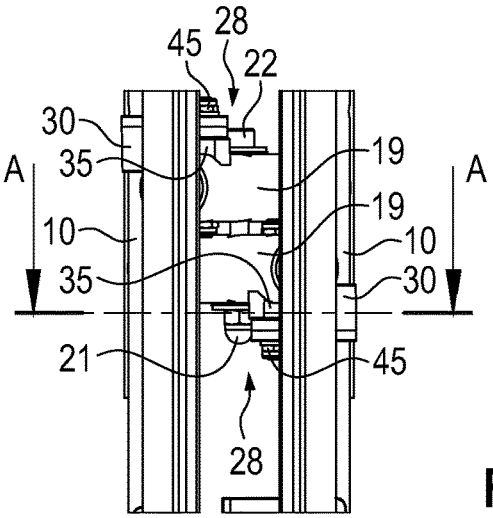
FIG. 13 shows a view of the wheelchair as per FIG. 12, illustrated in a view from above in a partial region, specifically the region of the cross-strut assembly.
Figure 14:
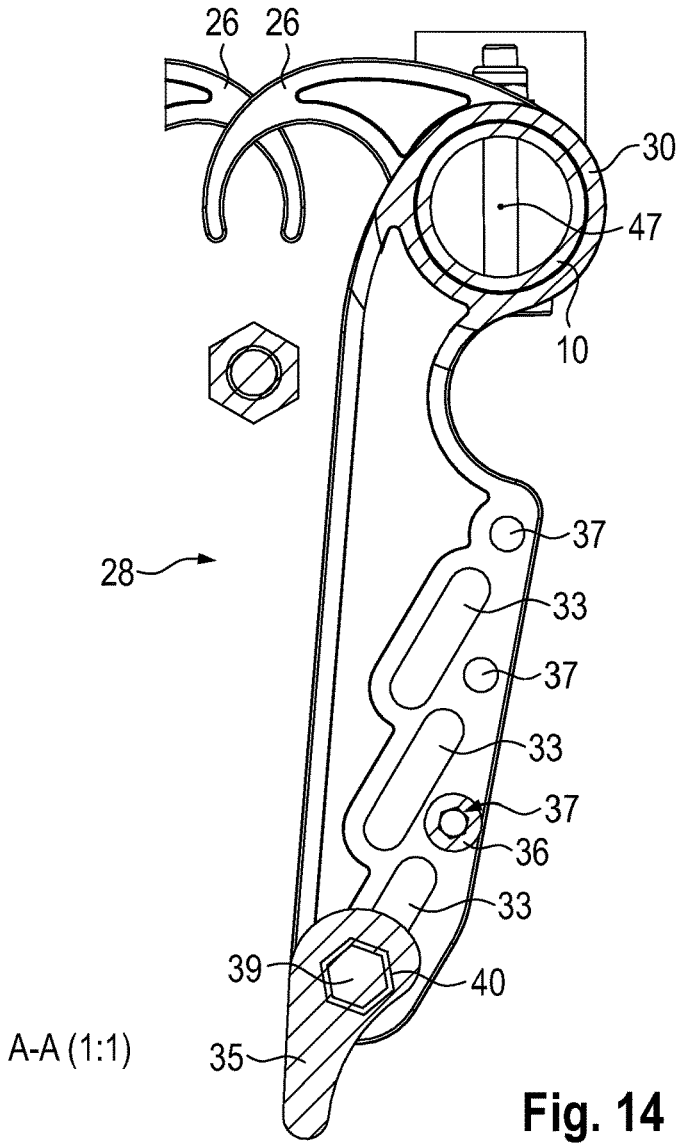
FIG. 14 shows a section as per the line A-A in FIG. 13, in an enlarged illustration.

The following description relates firstly to the illustration of FIGS. 1 and 3, which relate to features which, in the foldable wheelchair 1 according to the prior art as per FIG. 1, are identical to those of the foldable wheelchair according to the present invention, that is to say as per FIG. 3. For a better overview of the kinematics of the parts of the wheelchair 1, the seat cover and the back cover have been omitted in the illustration of the wheelchair 1.

The foldable wheelchair 1 has side frames 2 arranged on both sides of the wheelchair 1, a cross-strut assembly 3, and seat tubes 4 for holding a seat cover. When the wheelchair 1 is fully unfolded, the seat cover mounted in the two parallel seat tubes 4 is tensioned.

The respective one of the two side frames 2 of Mirror-symmetrical identical form is formed as a frame formed from individual tubes. A rear tube 5 of the respective side frame 2 receives a height-adjustable tube 6, which is arranged substantially vertically in the usage position of the wheelchair 1 and which is connected, in the region of its upper end, to an angled tube 7, which receives a pushing handle 8. The tubes 6 hold the back cover, which extends in a taut manner between said tubes. The tubes 6 are arranged parallel to one another.

The respective side frame 2 is formed substantially by the rear tube 6, by a front tube 9 and by horizontally arranged tubes 10 and 11 which connect the tubes 6 and 9. Into the front tube 9, from below, there is inserted a tube 12 which is connectable to the tube 9 in different positions of deployment and which, in the region of its lower end, holds a pivotable footrest 13. To the lower tube 11, in the region of its end facing toward the tube 9, there is connected a holder 14 in which a front wheel 15 of the wheelchair 1 is pivotably mounted. In the region of the tube 5, a bearing plate 16 extending parallel to the tube 5 is connected to the tubes 10 and 11, in which bearing plate there is mounted a wheel hub 17 which holds a rear, large wheel 18 of the wheelchair 1.

The cross-strut assembly 3 has two struts 19, wherein an axis of rotation 20 of the cross-strut assembly 3 is formed approximately in the middle of the length of the respective strut 19. In the region of the axis of rotation 20, a bolt 21 extends through bores in the two struts 19 and is fixed in the region of its free end by means of a self-locking nut 22. Washers 23 are arranged between the bolt 21 and the associated strut 19 and between the nut 22 and the associated strut 19. The pivot axis of the respective strut 19 runs parallel to the longitudinal extent of the tubes 10 and 11.

A tube 24 is fixedly connected to the respective strut 19 in the region of the lower end thereof. The lower tube 11 extends through the tube 24 with a small degree of play, wherein the tube 24 is fixed axially on the tube 11, and is thus pivotably mounted in the tube 11. The respective strut 19 is connected, in the region of its upper end, to the seat tube 4. The seat tube 4 is equipped, over its length, with a slot 25 for receiving the facing end of the seat cover.

The respective side frame 2 has, on its side facing toward the other side frame 2, specifically in the region of the tube 10 thereof, a seat tube bearing 26 for receiving the associated seat tube in the unfolded position of the wheelchair 1. Said seat tube bearing 26, more specifically to identical components of the seat tube bearing 26, are connected to the tube 10 in regions which are positioned adjacent to the ends of the seat tube 4. The seat tube bearings 26 have an upwardly open trough-shaped element 27 which has a cross section which extends over approximately a semicircle.

The cross-strut assembly 3 is thus, in the regions remote from the seat tubes 4, that is to say in the region of the tubes 24 thereof, mounted in the side frames 2, specifically the tubes 11, so as to be pivotable about pivot axes that are arranged parallel. The axis of rotation 20 of the struts 19 of the cross-strut assembly 3 is arranged parallel to said pivot axes, assigned to the tubes 24, of the cross-strut assembly 3.

The wheelchair 1 has guide levers 28 on both sides, that is to say two guide levers 28. The respective guide lever 28 is mounted, in a first region 29, in the associated strut 19. The mounting of the struts 19 is realized in a region between the axis of rotation 20 of the struts 19 and the seat tube 4 arranged in said region. The guide lever 28 is mounted, at a distance from the mounting of the guide lever 28 in the strut 19, in the side frame 2 assigned to said seat tube 4, specifically in the tube 10 of said side frame, so as to be pivotable about the pivot axis formed in the longitudinal direction of said tube. Here, the guide lever 28 has an end-side tube section 30 which the tube 10 extends through in a guided manner. Thus, the mounting of the guide lever 28 in the side frame 2 is realized in the second region 31 thus described.

In the embodiment according to the prior art as per FIG. 1, the respective guide lever 28 is mounted, in its first region 29, about a fixed pivot axis 32 in the associated strut 9. This has the effect that, as can be seen in the illustration in FIG.

2, relating to the prior art, in the case of a partially folded wheelchair, the two side frames 2 are moved away from one another in the region of their upper ends and, instead of the parallel position, now assume a V-shaped position. Thus, in this early phase of the folding process, the back tubes—tubes 6—move away from one another and generate a high tension on the back cover. With regard to the details and in particular the disadvantages of this wheelchair construction, reference is made to the detailed statements in the introductory part of the description.

The wheelchair 1 according to the invention, as illustrated in FIGS. 3 to 14, is modified in the region of the attachment of the respective guide lever to the strut 19 assigned thereto. As can be seen in particular from the detail illustration as per FIG. 4, the guide lever 28 has, in its first region 29, a guide slot 33, and a guide pin 34 is connected to the strut 19 assigned to the guide lever 28, which guide pin engages into the guide slot 33. Furthermore, a cam 35 is connected to said strut 19, and a cam follower is connected to the guide lever 28 in the first region 29 thereof.

In detail, the guide slot 35 is formed as an oblong hole which traverses the guide lever 28. A hole 37 in the guide lever 28 serves for receiving the cam follower 36, which is easily realized by the head of a cylinder screw which is screwed into the hole 37. Various illustrated guide slot 33 or elongated holes and different holes assigned to the guide slots 33 represent different seat widths of a wheelchair. Thus, a guide lever 28 with multiple guide slots 33 and multiple holes 37 can be used for different wheelchair widths.

The cam 35 is fastened to the strut 19 by means of a cam fastening 38. Said cam fastening 38 is formed substantially as a peg which, in the region of one end thereof, forms the guide pin 34 and, in the region of its other end, has a threaded section. The peg has, in the region of its end remote from the free end of the guide pin 24, a hexagonal collar 39 which, for rotational securing purposes, engages in positively locking fashion into a depression 40 of the cam 35. The threaded section of the cam fastening 38 extends through the strut 19 and receives a nut 41 for the axial fixing of the cam fastening 38 with respect to the strut 19. A cylinder head screw 42 which has the cam follower 36 extends through the hole 37 in the guide lever 28, and a nut 43 is screwed onto the free end of the cylinder head screw 42. The free end of the guide pin 34 is also provided with a thread. The guide pin 34 extends through the guide slot 33, and a washer 44 is placed onto the free end of the guide pin 34, and a nut 45 is screwed onto the threaded section.

Owing to the structural design of the wheelchair 1, it is now possible, during the folding process of the wheelchair 1, for the horizontal spacing from the axis of rotation 46 on the strut 19 to the axis of rotation 47 on the side frame 2, specifically the longitudinal central axis of the tube 10, to be substantially maintained by displacement of the guide lever 28 on the guide pin 34 along the guide slot 33 of the guide lever 28, and thus for the side frames 2 to be kept substantially parallel. It is thereby ensured that the back cover is not subjected to excessive tension, and structural elements of the wheelchair are not subjected to excessive load, in any phase of the folding process.

In order that, at the end of the unfolding process, the seat tubes 4 can be inserted as exactly as possible into the seat tube bearings 26 of the seat frames 2, the side frames 2, specifically the tubes 10 thereof, must be positively guided into the corresponding position. The guide slots 33 in the guide levers 28 would, in this phase of the folding process, allow the side frames 2 to pivot inward (in the direction of the cross-strut assembly articulation point), whereby the seat tubes 4 would miss the seat tube bearings 26, and the wheelchair 1 cannot be correctly unfolded.

The exact guidance is performed by the cam 35 and the respective cam follower 36: during the unfolding of the wheelchair 1, the cam follower 36 bears against a cam track 48 of the cam 35 and displaces the guide lever 28 along its guide slot 33 during the unfolding process, as far as that end 49 of said guide slot which is remote from the tube section 30, wherein said end 49 in turn corresponds to the position at the end of the unfolding process, at which the seat tube 4 can be inserted exactly into the associated seat tube bearing 26.

The orientation of the respective cam 35 on the strut 19 of the cross-strut assembly 3 and the design of the associated cam track 48 are dependent on the geometrical conditions of the wheelchair construction. In the embodiment described here, to which there is no restriction, the center line 50 of the cam 35 and the longitudinal axis 51 of the strut 19 assume an angle of 30°, and the cam track 48 that communicates with the cam follower 36 forms a concave surface.

That which is claimed:

1. A foldable wheelchair having side frames arranged on both sides of the wheelchair, a cross-strut assembly and seat tubes for receiving a seat cover, wherein the cross-strut assembly is mounted, in regions remote from the seat tubes, about parallel pivot axes in the side frames, and an axis of rotation of struts of the cross-strut assembly is arranged parallel to the pivot axes of the cross-strut assembly, and the cross-strut assembly is connected to the seat tubes, which, in an unfolded position of the wheelchair, are received by seat tube bearings of the side frames, wherein the wheelchair has guide levers on both sides, and each guide lever is mounted, in a first region, in the respective strut of the cross-strut assembly, in a region of the cross-strut assembly between the axis of rotation of the struts of the cross-strut assembly and the respective seat tube, and the guide lever is mounted at a distance therefrom, in a second region, in the side frame assigned to the seat tube so as to be pivotable about a pivot axis, wherein the pivot axis is arranged parallel to the pivot axes of the cross-strut assembly in the side frames, and wherein each guide lever has a guide slot in the first region, and a guide pin, which engages in the guide slot, is connected to the strut assigned to the guide lever, and a cam is connected to the strut, and a cam follower is connected to the guide lever in the first region, wherein the cam and the cam follower interact in an end phase of an unfolding process of the wheelchair for the purpose of displacing the guide pin into a defined position in the guide slot.

2. The wheelchair as claimed in claim 1, wherein the cam and the cam follower are out of contact before reaching the end phase of the unfolding process of the wheelchair.

3. The wheelchair as claimed in claim 1, wherein in the defined position of the guide pin in the guide slot, the seat tube connected to the strut can be moved into the seat tube bearing assigned to the seat tube.

4. The wheelchair as claimed in claim 1, wherein the respective seat tube bearing is designed to be upwardly open in order to move the seat tube assigned to the seat tube bearing when unfolding the wheelchair with a movement component directed toward the opening of the seat tube bearing.

5. The wheelchair as claimed in claim 1, wherein the seat tube bearing is formed as an upwardly open trough-shaped element having a cross section which extends over at least a portion of a circle.

6. The wheelchair as claimed in claim 1, wherein the guide slot takes the form of an oblong hole traversing the guide lever.

7. The wheelchair as claimed in claim 1, wherein the guide pin is a constituent part of a fastening element which serves for fastening the cam to the strut.

8. The wheelchair as claimed in claim 1, wherein the defined position of the guide pin in the guide slot is a position of the guide pin at one end of the guide slot.

9. The wheelchair as claimed in claim 8, wherein the end of the guide slot is an end that is remote from the seat tube facing the strut.

10. The wheelchair as claimed in claim 1, wherein a cam track of the cam forms a concave surface.

11. The wheelchair as claimed in claim 1, wherein a center line of the cam and a longitudinal axis of the strut receiving the cam assume an angle of between 20° and 40° with respect to one another.

12. The wheelchair as claimed in claim 1, wherein with the wheelchair unfolded, the seat tube is arranged adjacent to a tube portion of the associated side frame.

13. The wheelchair as claimed in claim 1, wherein the guide lever has in the first region the guide slot comprising a plurality of guide slots.

14. The wheelchair as claimed in claim 13, wherein the guide lever has a plurality of holes corresponding to the plurality of guide slots, wherein each guide slot is assigned a respective hole, and in this arrangement one of the holes-receives the cam follower and one of the guide slots receives the guide pin.

15. The wheelchair as claimed in claim 14, wherein the guide slots are arranged parallel to one another or the respective hole is arranged in the continuation of the associated guide slot.

* * * * *